US005937255A

United States Patent [19]

Kagawa

[11] Patent Number: 5,937,255

[45] Date of Patent: Aug. 10, 1999

[54] FUSER HAVING RELEASE AGENT SUPPLY MEANS COMPRISING FLUORORESIN FIBERS

[75] Inventor: Toshiaki Kagawa, Sakurai, Japan

[73] Assignee: Sharp Kabushiki Kaisha, Osaka, Japan

[21] Appl. No.: 09/053,186

[22] Filed: Apr. 1, 1998

[30] Foreign Application Priority Data

Apr. 11, 1997 [JP] Japan ..... 9-092663

[51] Int. Cl.[6] ..... G03G 15/20

[52] U.S. Cl. ..... 399/324; 399/325; 399/326; 399/327

[58] Field of Search ..... 399/324, 325, 399/326, 327, 329; 492/56

[56] References Cited

U.S. PATENT DOCUMENTS 5,289,246 2/1994 Menjo ..... 399/324 X
5,697,036 12/1997 Moser ..... 399/329
5,776,043 7/1998 Kato et al. ..... 399/329

FOREIGN PATENT DOCUMENTS 83-111963 4/1983 Japan ..... G03G 15/20
58-111963 7/1983 Japan .

*Primary Examiner*—Richard Moses
*Assistant Examiner*—Shival Virmani
*Attorney, Agent, or Firm*—Dike, Bronstein, Roberts & Cushman,LLP; David G. Conlin; George W. Neuner

[57] ABSTRACT

A fuser having an oil applying felt composed of fluororesin fibers and touching to an oil applying roller. The oil applying felt is dipped in oil preserved in an oil tank at one end, so that the oil is elevated through capillarity and supplied to the oil applying roller. The oil applied over the oil applying roller is leveled by an oil limiting blade, and the oil thus leveled is applied to a fusing roller touching the oil applying roller. Meanwhile, a sheet having thereon formed a non-fused toner image is heated and pressed respectively by the fusing roller and a pressure applying roller, whereupon the non-fused toner on the sheet adheres to the fusing roller. The toner then adheres to the oil applying felt through the oil applying roller. However, the oil applying felt is not clogged with the toner because it is made of the fluororesin fibers.

50 Claims, 14 Drawing Sheets

FUSER HAVING RELEASE AGENT SUPPLY MEANS COMPRISING FLUORORESIN FIBERS

FIELD OF THE INVENTION

The present invention relates to a fuser employed in an electrophotographic apparatus using an electrophotographic process, such as a copying machine, a facsimile machine, and a printer, more particularly, to a fuser employed in a full-color electrophotographic apparatus.

BACKGROUND OF THE INVENTION

A heat roller fusing method has been generally adopted for a fuser employed in an electrophotographic apparatus, such as. a copying machine and a printer. According to the heat roller fusing method, a recording sheet having thereon formed a non-fused toner image is passed through a space between a pair of rollers heated and pressed against each other, whereby the toner image is fused and fixed onto the recording sheet. However, the heat roller fusing method has a problem that there readily occurs a so-called offset phenomenon, in which the fused toner on the recording sheet adheres to the rollers. The frequency of the offset phenomenon is particularly high with a color electrophotographic apparatus, because the color toner has poor mold release characteristics compared with the conventional black toner.

Therefore, to prevent the offset phenomenon, an offset preventing agent having small surface energy, such It as silicon oil, is essentially applied over the roller surface of the fuser employed in today's electrophotographic apparatus, especially in the color electrophotographic apparatus.

A typical oil applying device used for the fuser of this type will be explained in detail with reference to FIG. 14.

The oil applying device includes an oil applying roller 61, an oil applying felt 62, an oil limiting blade 68, an oil tank 69, etc. The oil applying felt 62 is provided in such a manner that its top end touches the oil applying roller 61, and its bottom end is dipped in oil 70 preserved in the oil tank 69. The oil applying felt 62 elevates the oil 70 in the oil tank 69 through capillarity and applies the same over the surface of the oil applying roller 61. The oil limiting blade 68 is pressed against the oil applying roller 61 at a certain pressure and scrapes off excessive oil, so that a certain amount of oil is applied uniformly over the surface of the oil applying roller 61. The oil thus leveled is transferred to a fusing roller 51 at a press contacting portion H between the oil applying roller 61 and fusing roller 51, and applied over the surface of the fusing roller 51.

As disclosed in Japanese Laid-Open Patent Application No. 111963/1983 (Tokukaisho No. 58-111963), for example, a fluorine-based porous material (for example, polytetrafluoroethylene (PTFE), such as GORE-TEX® of W. L. Gore Inc.,) is proposed as a material for the oil applying felt 62 to reduce an amount of supplied oil.

However, the conventional oil applying device has five following problems.

① When the toner adheres to the surface of the fusing roller 51 (hereinafter, this phenomenon is referred to as offset), the toner also adheres to the oil applying felt 62 through the oil applying roller 61. When this happens, the pores of the oil applying felt 62 made of a fluorine-based porous material are clogged with the toner, and as a consequence, the oil applying felt 62 can no longer supply the oil to the oil applying roller 61.

② An amount of applied oil over the oil applying roller 61 varies with the surface roughness of the oil applying roller 61. That is, when the surface roughness of the oil applying roller 61 is small, less amount of oil is carried beyond the edge portion of the oil limiting blade 68, and hence an amount of the applied oil over the oil applying roller 61 decreases; on the other hand, when the surface roughness of the oil applying roller 61 is large, an amount of the applied oil increases.

In the conventional oil applying device, the surface roughness of the oil applying roller 61 diminishes with the use as the oil limiting blade 68 repetitively slides over the oil applying roller 61. Thus, an amount of the applied oil is reduced eventually throughout the life of the fuser, thereby causing the offset or the like in the end. Conversely, if the oil is supplied in a sufficient amount to prevent the offset throughout the life, the oil is supplied excessively at the beginning of the life, thereby undesirably increasing an amount of the used oil.

③ An amount of the applied oil over the oil applying roller 61 also varies with a press contacting pressure at the edge portion of the oil limiting blade 68 against the oil applying roller 61. That is, the lower the press contacting pressure, the more an amount of the applied oil, and the higher the press contacting pressure, the less an amount of the applied oil.

In the conventional oil applying device, the press contacting pressure of the oil limiting blade 68 is generally higher at each end portion than at the central portion due to the flexure of the oil limiting blade 68 and oil applying roller 61 in their longitudinal directions. Consequently, an amount of the applied oil varies in the longitudinal direction. When the oil is applied nonuniformly in the above manner, there occurs an image deficiency, such as inconsistencies in gloss and unwanted transmittance variations of an OHP.

④ Since the oil applying felt 62, oil limiting blade 68 and the like are pressed against the oil applying roller 61, a driving torque of the oil applying roller 61 is so large that it has to be forced to rotate. However, it is difficult to drive the oil applying roller 61 in a stable manner, and the oil applying roller 61 readily starts to vibrate at a driving gear pitch with respect to the fusing roller 51. As a result, the oil is applied nonuniformly near the driving gear in response to the driving gear pitch (hereinafter, this phenomenon is referred to as oil banding). When the oil is applied nonuniformly in the above manner, there occurs an image deficiency, such as inconsistencies in gloss.

⑤ The offset occurs when an amount of the applied oil is too small. On the other hand, when too much oil is applied, an image portion remains on a recording sheet as a memory at a cycle of the fusing roller 51 (hereinafter, this phenomenon is referred to as oil ghost). The oil ghost occurs for the following reason. That is, the oil is absorbed into the toner in the image portion whereas it is not in the non-image portion, which causes considerable amount variations of the oil over the fusing roller 51. Under these conditions, when the fusing roller 51 rotates once and the oil is applied again by the oil applying roller 61, the amount variations thus caused are not eliminated and the oil is still applied nonuniformly, thereby causing the oil ghost. The oil ghost causes an image deficiency, such as inconsistencies in gloss and unwanted transmittance variations of the OHP.

SUMMARY OF THE INVENTION

It is therefore an object of the present invention to provide a fuser which can supply oil to a fusing roller in a stable manner.

To fulfill the above object, a first fuser of the present invention is furnished with:

a fusing section for fusing a non-fused toner image onto a recording material by heating and pressing;

an applying section for applying a mold release agent over a fusing surface of the fusing section to remove toner adhering to the fusing surface; and a supplying section for supplying the mold release agent to the applying section, a surface of the supplying section touching the applying section being made of fluororesin fibers.

Also, to fulfill the above object, a second fuser of the present invention is furnished with:

a fusing section for fusing a non-fused toner image onto a recording material by heating and pressing; and a supplying section for supplying a mold release agent to the fusing section, a surface of the supplying section touching the fusing section being made of fluororesin fibers.

According to the above arrangements, a non-fused toner image is formed on a recording material, such as a paper sheet, which is transported to the fusing section, such as a fusing roller, so that the non-fused toner image is fused thereon. In the second fuser, the mold release agent, such as oil, is supplied to the fusing section from the supplying section that touches the fusing section. In the first fuser where the applying section is provided between the supplying section and fusing section, the mold release agent is supplied to the fusing section from the supplying section through the applying section and applied thereon. Therefore, the fusing section or applying section is arranged to touch the supplying section.

Thus, the non-fused toner on the recording material may adhere to the supplying section through the fusing section or applying section touching the fusing section. Under these conditions, when a considerable amount of toner adheres to the supplying section, the oil can not be supplied in a stable manner unless a countermeasure is taken. Thus, according to the above arrangement, the surface of the supplying section touching the fusing section or applying section is made of the fluororesin fibers. When arranged in this manner, even if the touching surface is stained with the toner, the clogging does not occur, and the oil can be supplied unless the touching surface is completely covered with the toner. Thus, it has become possible to supply the oil in a stable manner throughout the life of the fuser.

For a fuller understanding of the nature and advantages of the invention, reference should be made to the ensuing detailed description taken in conjunction with the accompanying drawings.

BRIEF DESCRIPTION OF THE DRAWINGS

FIG. 9(*b*) is a view explaining a case where the polishing treatment is applied to the oil applying roller in a backward direction with respect to the oil limiting blade;

FIG. 10(*b*) is a graph showing distributions of an amount of applied oil and surface roughness when the oil applying roller is polished in such a manner that the surface roughnesses at each end portion and at the central portion are same;

FIG. 13(*b*) is a cross section schematically showing an arrangement of a fuser in which the oil applying felt directly touches a fusing belt.

DESCRIPTION OF THE EMBODIMENTS

Embodiment 1

Referring to FIGS. 1 through 10, the following description will describe an example embodiment of the present invention. In the present embodiment, a fuser is employed in a monochrome laser printer as an example of the electrophotographic apparatus, but the application of the fuser is not limited to the laser printer.

Figure 5:
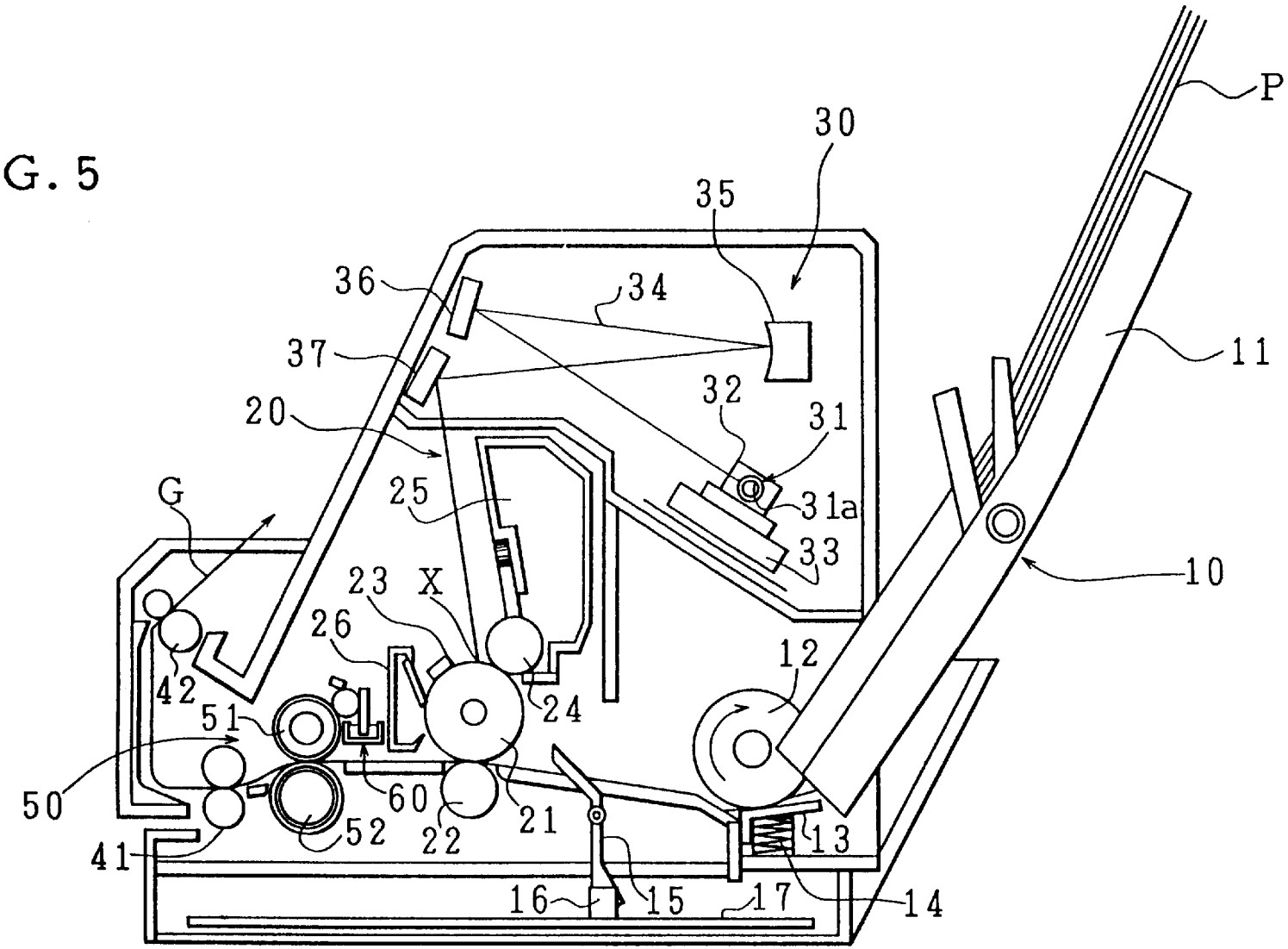
FIG. 5 is a cross section schematically showing an arrangement of a laser printer employing the fuser of FIG. 1.

As shown in FIG. 5, the laser printer in accordance with the present embodiment includes a sheet feeding section 10, an image forming device 20, a laser scanning section 30, and a fuser 50.

In the above-arranged laser printer, each sheet P is transported from the sheet feeding section 10 to the image forming device 20. The image forming device 20 forms a toner image based on a laser beam 34 emitted from the laser scanning section 30, and transfers the toner image thus formed onto the sheet P transported as a recording material. The sheet P having thereon transferred the toner image is further transported to the fuser 50, so that the toner image is fixed thereon. Finally, the sheet P having thereon fused the toner image is released to the outside of the apparatus by sheet transporting rollers 41 and 42 provided in the downstream along the direction in which the sheet P is transported from the fuser 50. In short, each sheet P is transported from a sheet feeding tray 11 to the image forming device 20 further to the fuser 50 in a route indicated by an arrow G in the drawing, and released to the outside of the apparatus.

The sheet feeding section 10 includes the sheet feeding tray 11, a sheet feeding roller 12, a sheet separating friction plate 13, a pressure applying spring 14, a sheet detecting actuator 15, a sheet detecting sensor 16, and a control circuit 17.

Upon issuance of a print command, the sheets P placed on the sheet feeding tray 11 are successively fed into the printer per sheet by the actions of the sheet feeding roller 12, sheet separating friction plate 13, and pressure applying spring 14. Each sheet P thus fed knocks down the sheet detecting actuator 15, whereupon the sheet detecting sensor 16 outputs an electric signal notifying the passing of the sheet P as a command to start the image printing. The control circuit 17 is activated by the action of the sheet detecting actuator 15, and sends an image signal to a laser diode emitting unit 31 in the laser scanning section 30, thereby controls the ON/OFF action of the laser diode.

The laser scanning section 30 includes the laser diode emitting unit 31, a scanning mirror 32, a scanning mirror motor 33, and reflecting mirrors 35, 36 and 37.

The scanning mirror 32 is driven to rotate at a fast constant speed by the scanning mirror motor 33. In other words, in FIG. 5, the laser beam 34 scans a photosensitive body 21 (which will be described below) perpendicularly with respect to the plane surface of the drawing. The laser beam 34 emitted from the laser diode emitting unit 31 is reflected by the reflecting mirrors 36, 35, and 37 and irradiated to the photosensitive body 21. Here, the laser beam 34 selectively exposes the photosensitive body 21 based on ON/OFF information from the control circuit 17.

The image forming device 20 includes the photosensitive body 21, a transferring roller 22, a charging member 23, a developing roller 24, a developing unit 25, and a cleaning unit 26.

The image forming device 20, with the use of the laser beam 34, forms an electrostatic latent image by selectively discharging the surface charges on the photosensitive body 21 which is pre-charged by the charging member 23. The toner used for the development is stored in the developing unit 25. The toner charged by being adequately stirred in the developing unit 25 adheres to the surface of the developing roller 24. Consequently, a toner image corresponding to the electrostatic latent image can be formed on the photosensitive body 21 by the action of the electrical field developed by a developing bias voltage given to the developing roller 24 and the surface potential of the photosensitive body 21.

The sheet P transported from the sheet feeding section 10 as the recording material is sent forward while being sandwiched by the photosensitive body 21 and transferring roller 22. Then, the toner on the photosensitive body 21 is electrically attracted to the sheet P and transferred thereon by the action of the electrical field developed by a transfer voltage applied to the transferring roller 22. The toner that has not been transferred is collected by the cleaning unit 26.

Subsequently, the sheet P is transported to the fuser 50. Then, adequate pressure and temperature are conferred to the sheet P respectively by a pressure applying roller 52 and the fusing roller 51 serving as fusing means and kept at 175° C., whereupon the toner is fused and fixed onto the sheet P, thereby forming an image in a stable manner.

Then, the sheet P is transported further by the sheet transporting rollers 41 and 42 and released to the outside of the apparatus.

Figure 1:
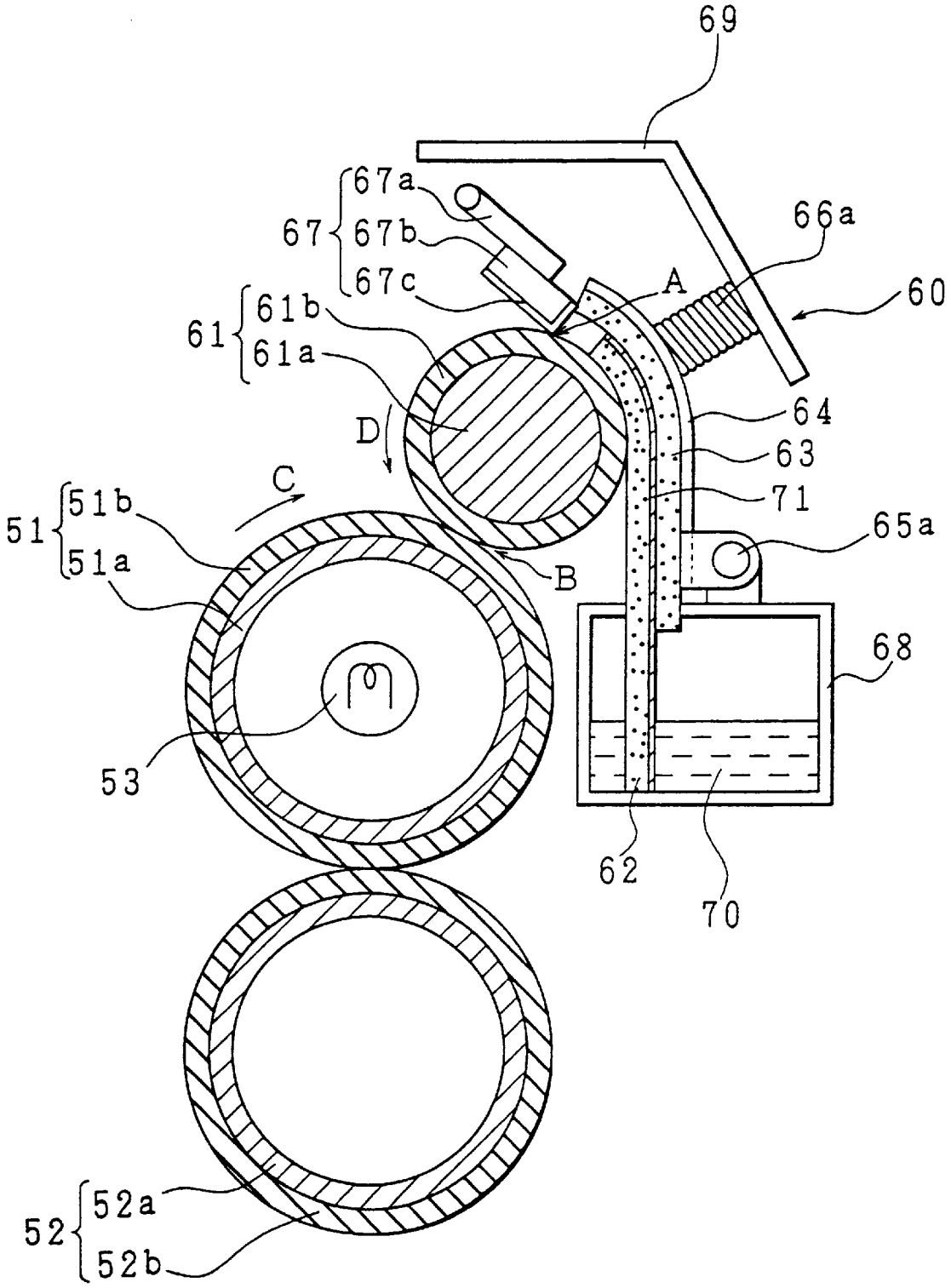
FIG. 1 is a cross section schematically showing an example arrangement of a fuser in accordance with an example embodiment of the present invention.
Figure 2:
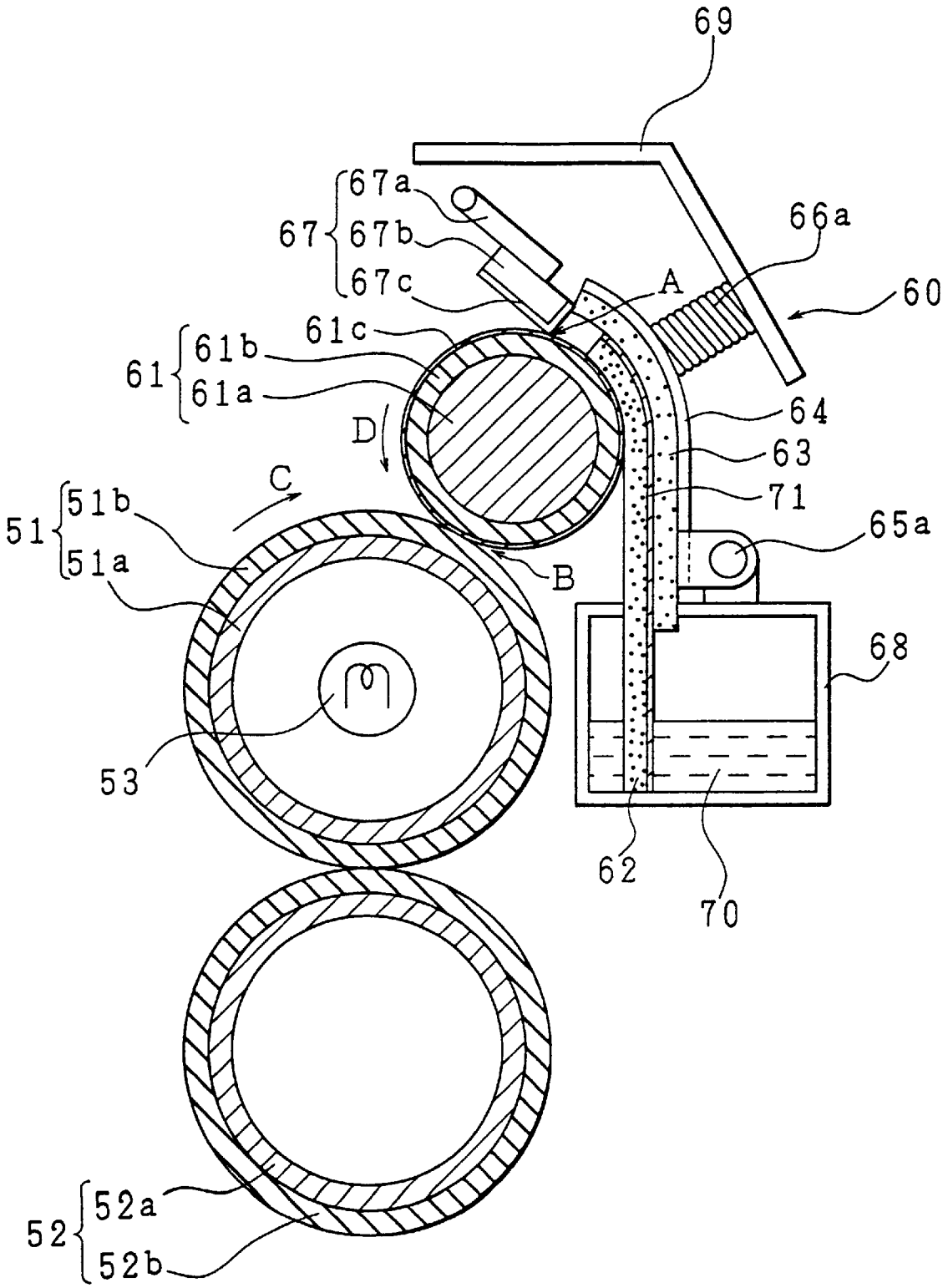
FIG. 2 is a cross section schematically showing another example arrangement of a fuser in accordance with the example embodiment of the present invention.
Figure 3:
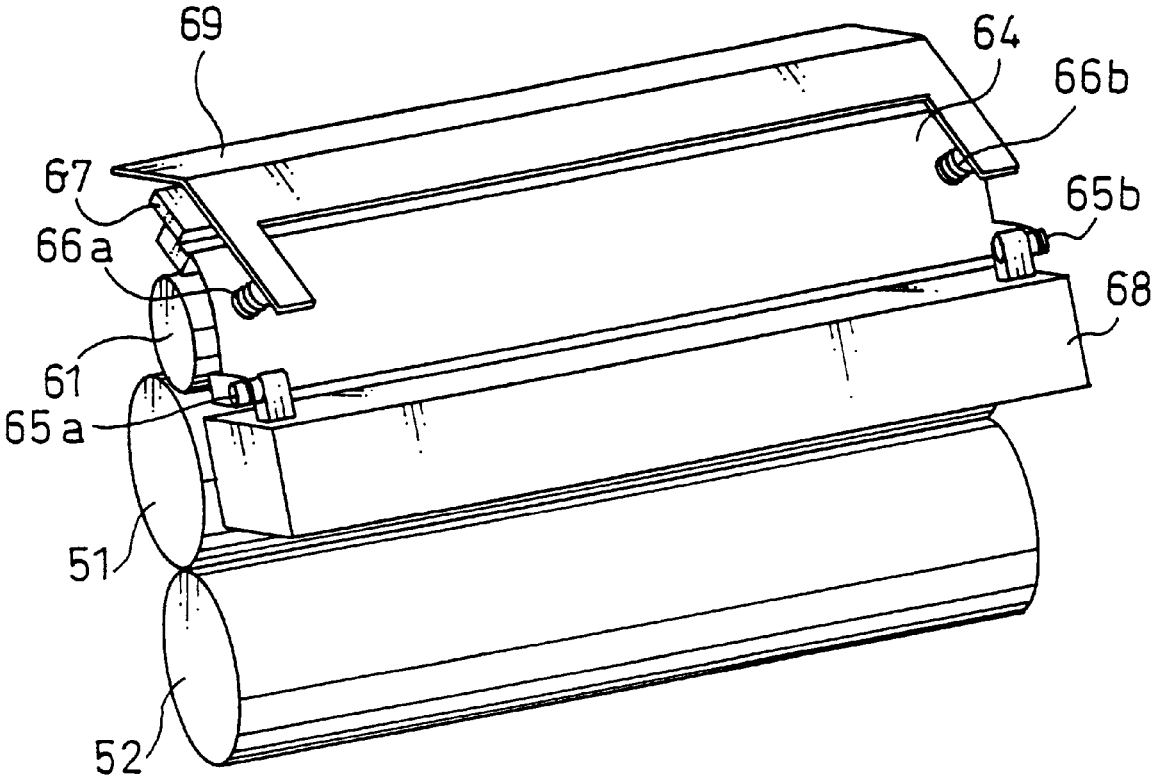
FIG. 3 is a perspective view schematically showing an arrangement of the fuser of FIG. 1 or 2.

Next, the fuser 50, which is the feature characteristic of the present invention, will be explained in detail with reference to FIGS. 1 through 3. FIGS. 1 and 2 are schematic cross sections of the fuser 50 of the present invention, and FIG. 3 is a schematic perspective view of an oil applying device.

The fusing roller 51 is composed of a hollow core material 51*a* made of aluminum which is coated with a mold release layer 51*b* made of silicon rubber. The pressure applying roller 52 is composed of a core material 52*a* made of stainless steel which is coated with an elastic layer 52*b* made of silicon rubber. The pressure applying roller 52 is pressed against the fusing roller 51 at a certain pressure by unillustrated pressure applying means. A heater lamp 53 is provided inside the fusing roller 51, and the heater lamp 53 heats the surface of the fusing roller 51 to a certain temperature (herein, 175° C.).

An oil applying device 60 comprises an oil applying roller 61, an oil applying felt 62, an oil collecting felt 63, a felt keeping plate 64, felt keeping plate supporting axes 65*a* and 65*b*, pressure applying springs 66*a* and 66*b*, an oil limiting blade 67, an oil tank 68, and a supporting frame 69. The oil tank 68 is filled with oil 70 made of dimethyl silicon oil (KF-96 of Shin-Etsu Chemical Co., Ltd).

The oil applying roller 61 serving as applying means is composed of a core material 61*a* made of stainless steel, which is coated with an LTV (Low Temperature Vulcanizing) silicon rubber layer 61*b* of 0.5 mm thick through compression molding. The oil applying roller 61 is supported so that it is allowed to rotate freely with respect to the supporting frame 69. An average surface roughness of the LTV silicon rubber layer 61*b* in its longitudinal direction, that is, the surface roughness (average roughness on the center line) Ra, is adjusted to 0.55 $\mu$m by applying the polishing treatment twice. Note that, however, the polishing treatment is applied in such a manner that the surface roughness differs at the central portion and at each end portion of the oil applying roller 61 in its longitudinal direction.

In the present embodiment, the polishing treatment is applied to the oil applying roller 61 so as to obtain Ra=0.4 $\mu$m at the central portion and Ra=0.7 $\mu$m at each end portion. However, the arrangement of the oil applying roller 61 is not limited to the above. For example, as shown in FIG. 2, the oil applying roller 61 may be composed of a core material 61*a* which is made of stainless steel, an LTV silicon rubber layer 61*b* of 0.5 mm thick formed to coat the core material 61*a* through the compression molding, and another LTV silicon rubber layer 61*c* of 0.04 mm thick formed to cover the LTV silicon rubber layer 61*b*. In this case, the surface of the oil applying roller 61 does not have to be polished, and the average surface roughness in the longitudinal direction is Ra=0.26 $\mu$m.

The oil applying roller 61 is pressed against the fusing roller 51 at a certain pressure by unillustrated pressure applying means. The oil applying roller 61 is set so as to be driven by unillustrated driving means to rotate in a direction indicated by an arrow D in the drawing as the fusing roller 51 rotates in a direction indicated by an arrow C in the drawing. The peripheral speed of the oil applying roller 61 is set to 83 mm/sec., which is slightly slower than the peripheral speed of the fusing roller 51, that is, 85 mm/sec. (thereby, making a peripheral speed ratio of 0.976).

Figure 4:
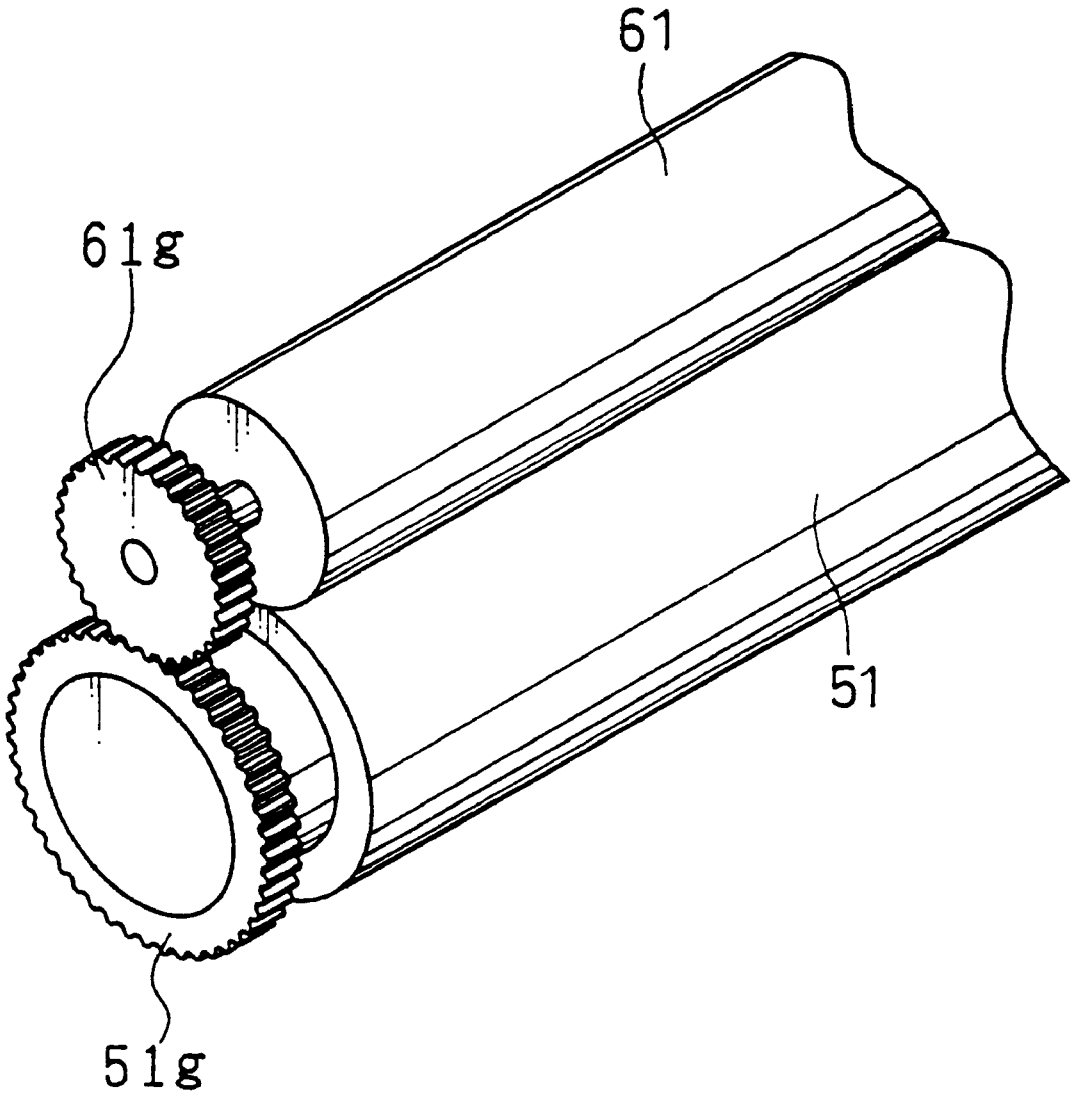
FIG. 4 is a perspective view showing an oil applying roller engaged with a fusing roller in the fuser of FIG. 1 or 2.

The above peripheral speed can be set by the arrangement specified below, but the peripheral speed can be found from the arrangement as well. As shown in FIG. 4, the oil applying roller 61 is engaged with the fusing roller 51 through gears 51*g* and 61*g*, so that it is driven to rotate as the fusing roller rotates. Here, the diameter of the fusing roller 51 is 30 mm, and the module and the number of teeth of the gear 51*g* is 0.5 and 60 (the diameter of the pitch circle is 30 mm), respectively. On the other hand, the diameter of the oil applying roller 61 is 18.06 mm and the number of teeth of the gear 61*g* is 37. The gear 61*g* is spaced apart from the gear 51*g* for a certain interval so as to engage with the same. Thus, the peripheral speed ratio of the oil applying roller and fusing roller 51 can be found as:

$$(18.06\times60)/(30\times37)=0.976.$$

The oil applying felt 62 serving as supplying means is a 2 mm-thick felt made of fibers of PTFE (polytetrafluoroethylene), and the oil collecting felt 63 serving as returning means is a 2 mm-thick felt made of aramid fibers (Nomex of du Pont, (E.I.) de Nemous & Co.). The oil applying felt 62 and the oil collecting felt 63 are laminated to each other through a PET (polyethylene terephthalate) film 71 of 0.1 mm thick. The oil collecting felt 63 of the two laminated felts is further laminated to the felt keeping plate 64 made of cold-rolled steel plate (SPCC) of 1mm thick, and the aforementioned elements are integrated into one body. The oil tank 68 is provided below the felt keeping plate 64. The felt keeping plate 64 is supported by the felt keeping plate supporting axes 65*a* and 65*b* provided fixedly on the upper surface of the oil tank 68 so that it is allowed to rotate freely.

The length of the oil applying felt 62 is set in such a manner that its top end touches the oil applying roller 61 and its bottom end is dipped in the oil 70 preserved in the oil tank 68 as a mold release agent. The oil collecting felt 63 is provided in such a manner that its top end approximates to the oil limiting blade 67 and its bottom end is inserted in the oil tank 68. However, the length of the oil collecting felt 63 is set so that its bottom end does not touch the liquid surface of the oil 70 even when the oil 70 is filled in the oil tank 68 up to its maximum amount. The felt keeping plate 64 is pressed toward the oil applying roller 61 at each end portion at a certain pressure by the pressure applying springs 66*a* and 66*b*, whereby the oil applying felt 62 touches the oil applying roller 61 at a certain pressure.

The oil limiting blade 67 is composed of a stainless blade holder 67*a*, a blade substrate 67*b* made of fluororubber, and a blade coating material 67*c* made of a fluororesin sheet. The oil limiting blade 67 is pressed against the oil applying roller 61 by unillustrated pressure applying means at a certain pressure.

In the above-arranged oil applying device 60, the oil is elevated from the oil tank 68 through the capillarity of the oil applying felt 62 and applied over the surface of the oil applying roller 61. The oil applied over the oil applying roller 61 is transported toward the oil limiting blade 67 as the oil applying roller 61 rotates in the direction indicated by an arrow D in the drawing. Then, excessive oil is scraped off by the edge portion A of the oil limiting blade 67 serving as leveling means, so that a certain amount of the oil is applied uniformly over the oil applying roller 61, after which the oil is transferred to the fusing roller 51 at a contact portion B between the oil applying roller 61 and fusing roller 51 and applied over the surface of the fusing roller 51. The oil scraped off by the edge portion A of the oil limiting blade 67 is absorbed in the oil collecting felt 63, and collected into the oil tank 68 through the PET film 71.

Here, the oil applying felt 62 of the present invention will be explained in detail with reference to experiment results.

To begin with, amount variations of the applied oil over the recording material throughout the aging with the continuous sheet passing are measured separately using porous PTFE (prior art) and the oil applying felt 62 made of PTFE fibers (present invention) as the oil applying member, and the result of which is explained below. An amount of the applied oil is measured in the following manner. That is, two OHP sheets are layered and let pass through a press contacting portion (hereinafter, referred to as a fusing nip portion) between the fusing roller 51 and pressure applying roller 52. Then, an amount of the applied oil over the recording surface is determined by a mass difference of the OHP sheet that has touched the fusing roller 51 before and after passing through the fusing nip portion.

The OHP sheet is used as the recording material because it is difficult to find an amount of the applied oil if a normal paper sheet is used. More specifically, when a normal paper sheet is used, the moisture in the paper sheet evaporates by the heat at the press contacting portion, and the mass of the paper sheet itself changes before and after the passing. Thus, it is very difficult to find an amount of the applied oil alone based on the mass difference of the paper sheet before and after the passing.

Figure 6:
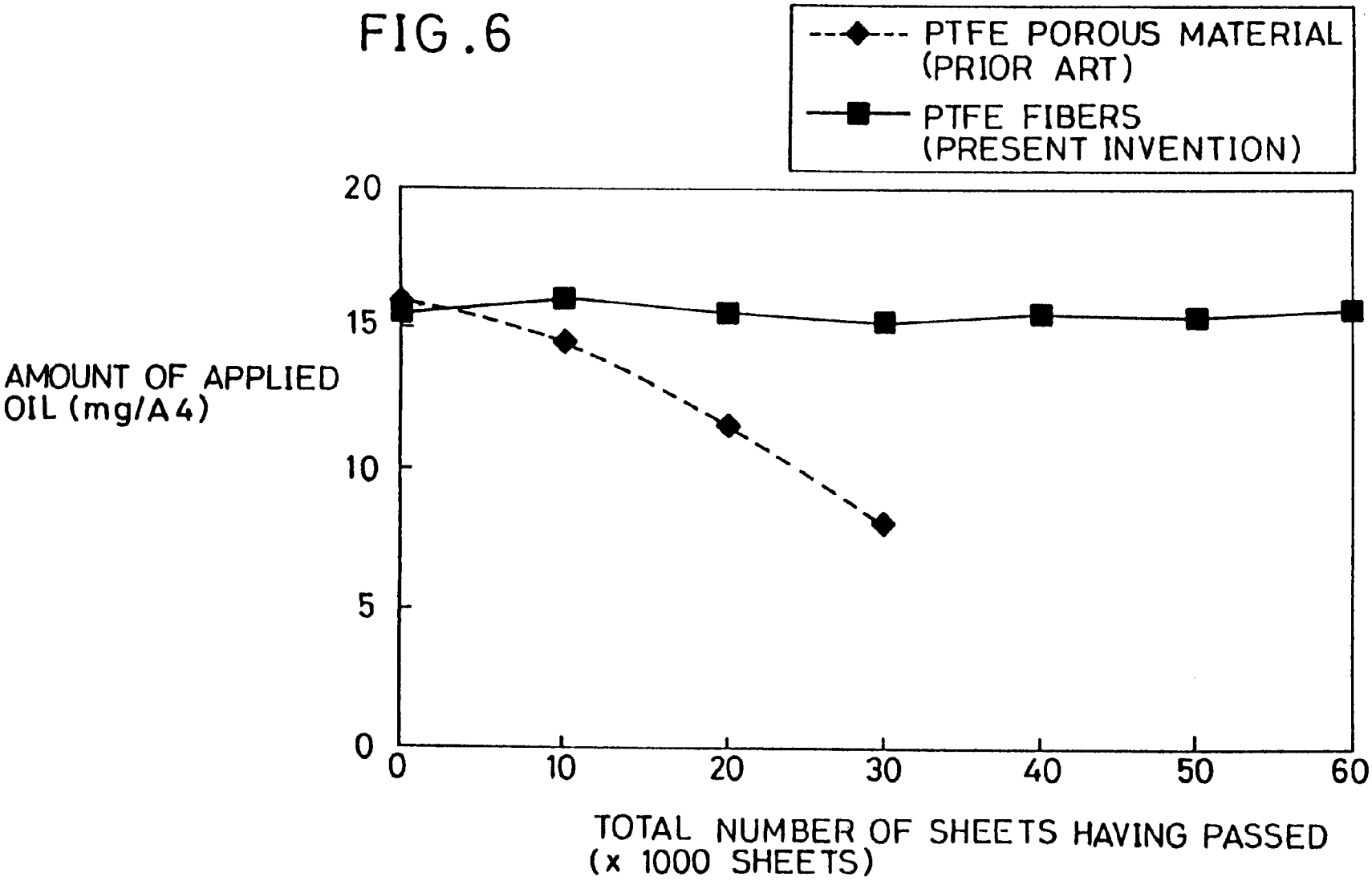
FIG. 6 is a graph showing amount variations of applied oil by an oil applying felt material throughout the aging with continuous sheet passing.

The measurement results as to the amount variations of the applied oil in the prior art and the present invention by the above measurement method are graphed in FIG. 6. The graph reveals that, in case of the conventional porous PTFE, an amount of the applied oil drops abruptly from the initial 16 mg/A4 to 8 mg/A4 when 30,000 sheets have been passed through, thereby causing the offset. This happens because the oil applying surface is stained with the toner, then the pores are clogged with the toner no matter how subtle the stain is, and the oil can no longer be supplied.

On the other hand, in case of the oil applying felt 62 of the present invention made of the PTFE fibers, even when the oil applying surface is stained with the toner, the oil can be supplied unless the applying surface is covered with the toner completely. Thus, an amount of the applied oil through the oil applying felt 62 is stabilized at around 16 mg/A4 throughout the life of the fuser.

Next, the oil applying roller 61 of the present invention will be explained in detail with reference to the experiment results.

Amount variations of the applied oil and the stain on the oil applying felt 62 throughout the aging with the continuous sheet passing are measured using Samples 1–4 set forth below as the surface coating layer of the oil applying roller 61, the results of which are set forth in Table 1 below and graphed in FIG. 7.

SAMPLES 1–4

SAMPLE 1: HTV (High Temperature Vulcanizing) silicon rubber of 0.5 mm thick formed through the compression molding to which the polishing treatment is applied once.

SAMPLE 2: LTV silicon rubber of 0.5 mm thick formed through the compression molding to which the polishing treatment is applied once.

SAMPLE 3: LTV silicon rubber of 0.5 mm thick formed through the compression molding to which the polishing treatment is applied twice.

SAMPLE 4: LTV silicon rubber of 0.5 mm thick formed through the compression molding and coated with LTV silicon rubber of 0.04 mm thick.

TABLE 1

| SAMPLE | SURFACE COATING LAYER OF OIL APPLYING ROLLER | NUMBER OF TIMES OF POLISHING TREATMENT | SURFACE ROUGHNESS (AVERAGE ROUGHNESS Ra ON THE CENTER LINE) (μm) INITIAL | AFTER PASSING 60,000 SHEETS | TONER STAIN ON OIL APPLYING FELT |
|---|---|---|---|---|---|
| 1 | HTV (0.5 mm) | ONCE | 1.13 | 0.37 | X |
| 2 | LTV (0.5 mm) | ONCE | 0.90 | 0.37 | ○ |
| 3 | LTV (0.5 mm) | TWICE | 0.55 | 0.36 | ⊙ |
| 4 | LTV (0.5 mm) + LTV (0.04 mm) | — | 0.26 | 0.25 | ⊙ |

⊙: VERY LITTLE TONER STAIN
○: SLIGHT TONER STAIN
X: CONSIDERABLE TONER STAIN

Figure 7:
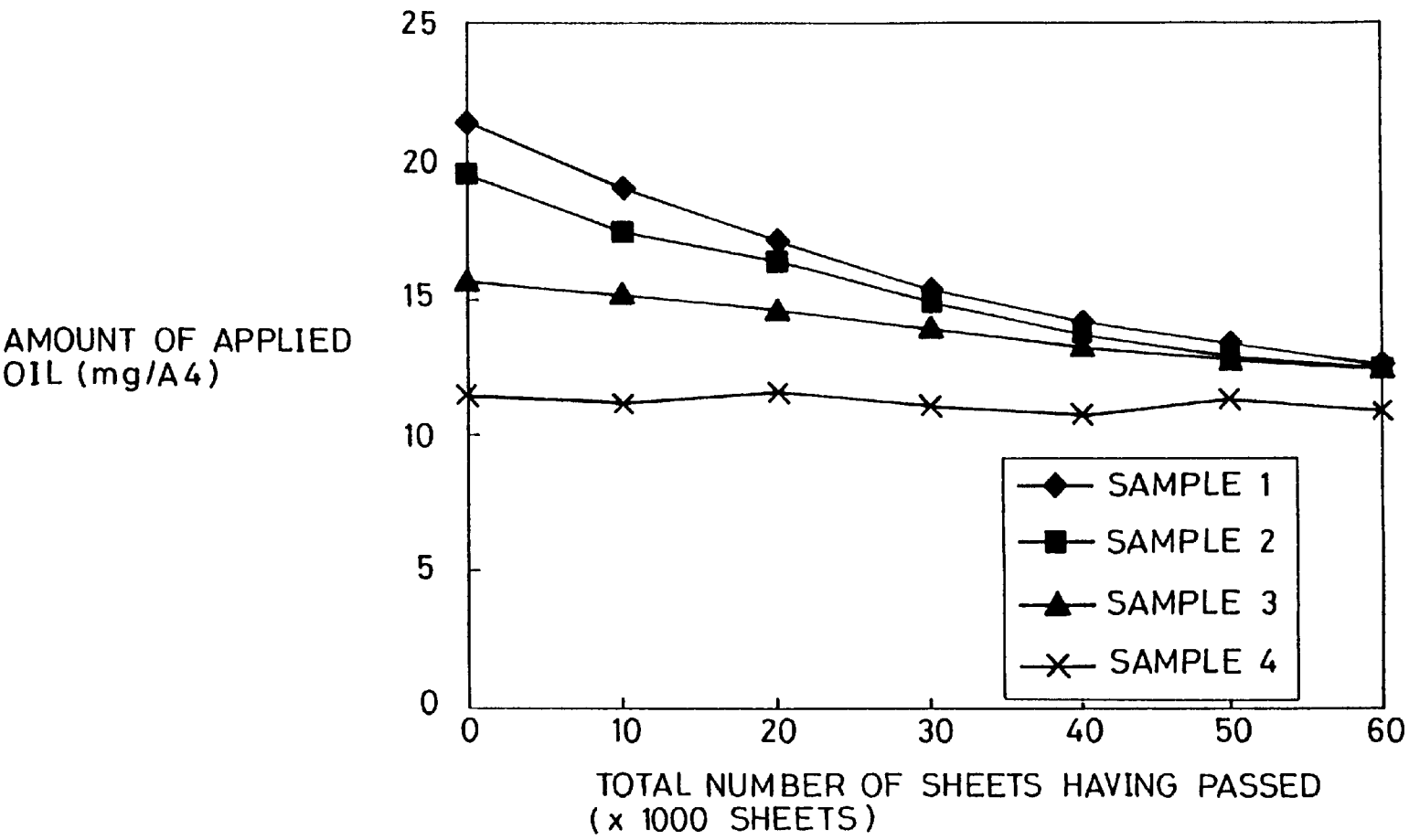
FIG. 7 is a graph showing amount variations of applied oil with a change of surface roughness of an oil applying roller throughout the aging with continuous sheet passing.

The graph in FIG. 7 reveals that an amount of the applied oil tends to decrease gradually throughout the life in each Sample. Also, the graph reveals that the smaller the surface roughness of the oil applying roller 61, the less a reduced amount of the applied oil, thereby achieving stable oil applying performance. This is because, as set forth in Table 1 above, with Samples having larger surface roughness, the performance varies as the surface roughness is diminished while the oil limiting blade 67 repetitively slides over the surface of oil applying roller 61.

Although it will be described below, the oil ghost occurs when an amount of the applied oil exceeds 20 mg/A4. Here, 20 mg/A4 indicates that 20 mg of oil is applied per A4-size recording material. In case of Sample 1 having an initial surface roughness Ra of 1.13 μm, an amount of the applied oil in the beginning of the life exceeds 20 mg/A4. Thus, the oil ghost occurs or a total amount of the used oil undesirably increases. Therefore, the surface roughness Ra of the oil applying roller 61 is preferably 0.9 μm or smaller.

As can be understood from Table 1 above, the smaller the surface roughness Ra of the oil applying roller 61, the less the toner stain on the oil applying felt 62. Further, as can be understood from the graph in FIG. 7, the smaller the surface roughness Ra of the oil applying roller 61, the less the amount variations of the applied oil. On the other hand, when the surface roughness Ra is smaller than 0.1 μm, it is known that an amount of the applied oil drops below 10 mg/A4. When this happens, the offset occurs as will be described below. In view of the foregoing, the surface roughness Ra of the oil applying roller 61 is preferably 0.1 μm or larger.

The measurement results as to the surface roughness are obtained where the oil limiting blade 67 is pressed against the oil applying roller 61 with a weight of 2 kgf (per 230 mm length). However, the similar effect is obtained under ideal pressure applying conditions: a weight of 1–3 kgf per 230 mm in length, in which the oil is applied in a stable manner without applying a large load to the oil applying roller 61.

To set the surface roughness of the oil applying roller 61 within the above range (between 0.1 μm and 0.9 μm inclusive), it is effective to apply the polishing treatment more than once in case that the surface coating layer of the oil applying roller 61 is made of LTV silicon rubber through the compression molding (Sample 3). However, a desired surface roughness is obtained without applying the polishing treatment in case that the surface coating layer is made of LTV silicon rubber through coat molding (Sample 4). In view of the foregoing, the oil applying roller 61 of Sample 3 or 4 is used in the p resent embodiment.

On the other hand, Table 1 above reveals that the toner stain on the oil applying felt 62 differs considerably depending on the kinds of the oil applying roller 61. When the toner adheres to the fusing roller 51 (when the offset occurs), some of the adhering toner also adheres to the oil applying roller 61 , thereby causing the toner stain on the oil applying felt 62. It is understood from Table 1 above that the smaller the surface roughness of the oil applying roller 61, the less an amount of the toner adhering to the oil applying roller 61, thereby causing less stain on the oil applying felt 62.

The comparison between Samples 1 and 2 reveals that there is a considerable difference in stains on the oil applying felt 62 when a difference of their surface roughnesses is minor. Thus, LTV silicon rubber of Sample 2 is assumed to have better mold release characteristics with toner than HTV silicon rubber of Sample 1. Therefore, it is preferable to use LTV silicon rubber as the surface material.

Next, the relation between the polishing direction on the surface of the oil applying roller 61 when the polishing treatment is applied and an amount of the applied oil over the recording material is examined, and the result of which is set forth in Table 2 below.

TABLE 2

| SURFACE COATING LAYER OF OIL APPLYING ROLLER | TIMES OF POLISHING TREATMENT | POLISHING DIRECTION | INITIAL STAGE Ra (μm) | INITIAL STAGE AMOUNT OF APPLIED OIL (mg/A4) | AFTER PASSING 60,000 PAPERS Ra (μm) | AFTER PASSING 60,000 PAPERS AMOUNT OF APPLIED OIL (mg/A4) |
|---|---|---|---|---|---|---|
| LTV (0.5 mm) | ONCE | BACKWARD | 0.90 | 19.6 | 0.37 | 12.3 |
| LTV (0.5 mm) | ONCE | FORWARD | 0.90 | 19.6 | 0.55 | 15.5 |

Figure 8:
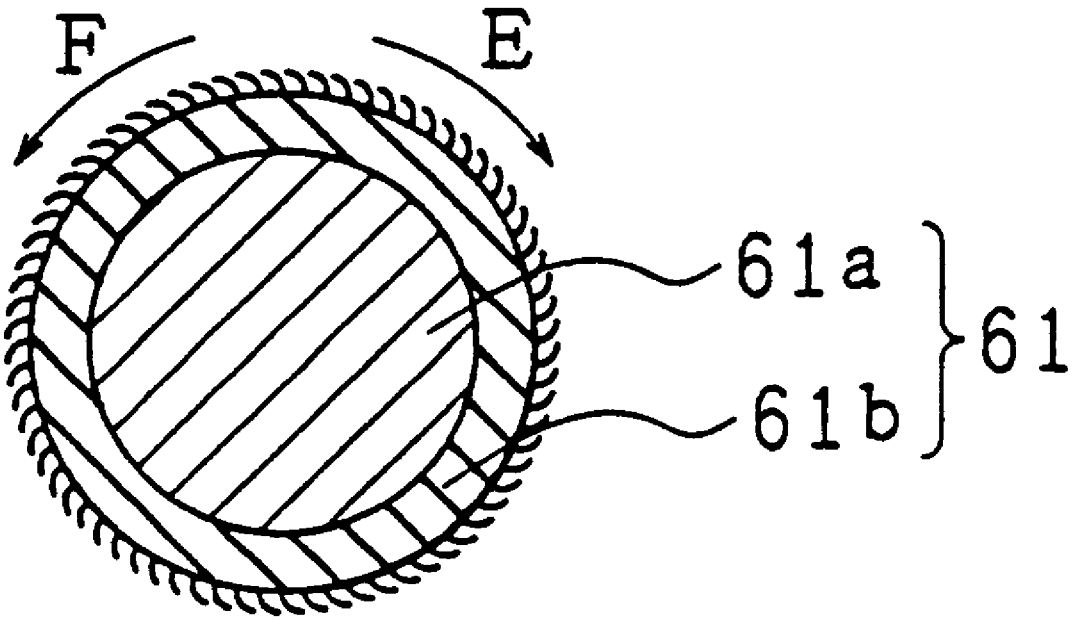
FIG. 8 is a view explaining a surface condition of the oil applying roller after the polishing treatment.
Figure 9:
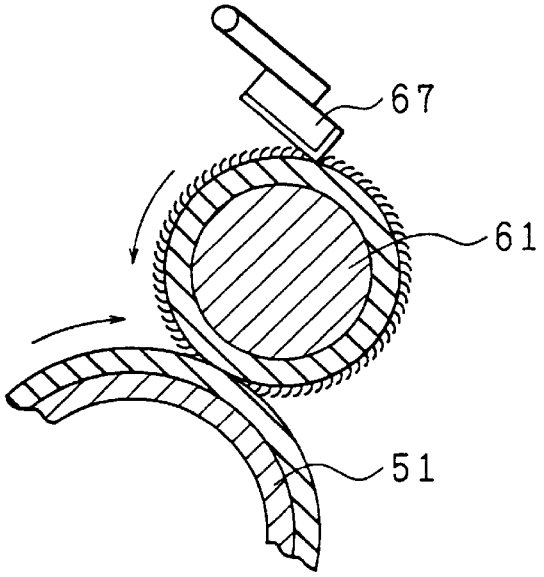
FIG. 9(*a*) is a view explaining a case where the polishing treatment is applied to the oil applying roller in a forward direction with respect to an oil limiting blade.
Figure 9:
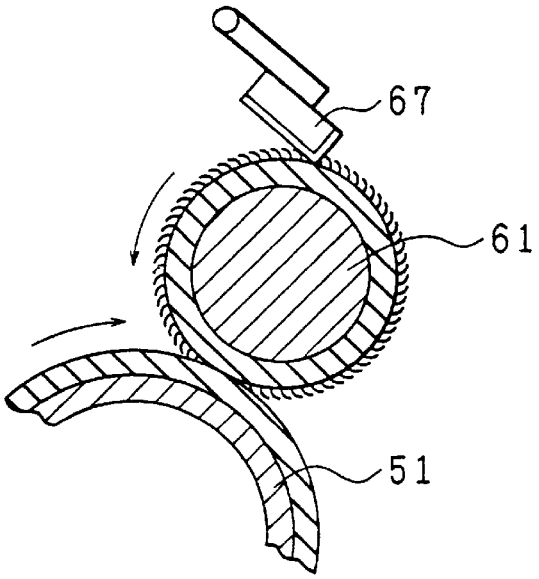

When the polishing treatment is applied on the surface of the oil applying roller 61, the polished oil applying roller 61 causes a surface friction in the circumferential direction. That is, an example surface condition of the polished oil applying roller 61 is illustrated in FIG. 8. To be more specific, when the oil limiting blade 67 acts a direction indicated by an arrow E with respect to the oil applying roller 61, there causes a large friction, whereas when the oil limiting blade 67 acts in the opposite direction indicated by an arrow F, there occurs a small friction. The "forward" direction referred in the experiment is illustrated in FIG. 9 (*a*), and it means that the oil applying roller 61 is provided in a direction to cause a small friction with the fusing roller 51 and oil limiting blade 67. The "backward" direction referred in the experiment is illustrated in FIG. 9 (*b*), and it means that the oil roller 61 is provided in a direction to cause a large friction.

Table 2 above reveals that the surface roughness varies less throughout the life (after having passed 60,000 sheets) when the oil applying roller 61 is provided in the forward direction than providing the same in the backward direction. Also, when the oil applying roller 61 is provided in the forward direction, an amount of the applied oil is stabilized compared with the case of providing the same in the backward direction.

Figure 10A:
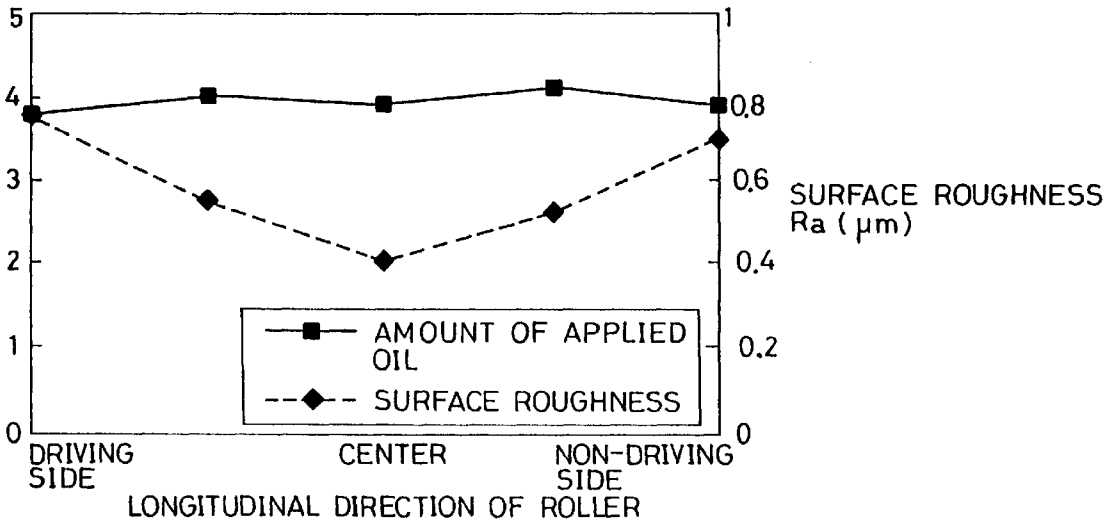
FIG. 10(*a*) is a graph showing distributions of an amount of applied oil and surface roughness in a comparative example, where the oil applying roller is polished in such a manner that the surface roughness at each end portion is larger than at the central portion.
Figure 10B:
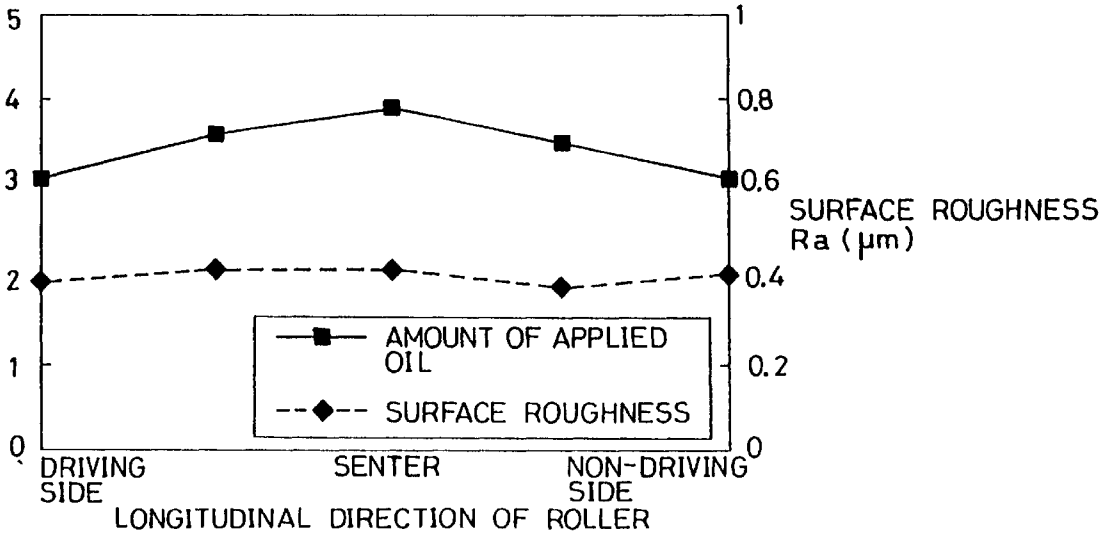

Next, the relation between distributions of the surface roughness in the longitudinal direction of the oil applying roller 61 of the present embodiment and the applied oil thereon is examined, and the result of which is graphed in FIG. 10(*a*). As previously mentioned, the oil applying roller 61 of the present embodiment is polished to establish a relation, Re>Rc, where Rc is the surface roughness at the central portion and Re is the surface roughness at each end portion. For the purpose of comparison, the distributions of the surface roughness in the longitudinal direction of the oil applying roller 61 and an amount of the applied oil thereon when the oil applying roller 61 is polished to establish Re=Rc are graphed in FIG. 10(*b*).

In the comparative case, an amount of the applied oil is increased at the central portion and decreased at each end portion This is because the press contacting pressure of the oil limiting blade 67 against the oil applying roller 61 is larger at each end portion than at the central portion due to the flexure of the oil limiting blade 67 caused by the pressing.

In contrast, the oil applying roller 61 of the present embodiment is arranged to have larger surface roughness at each end portion than at the central portion. Thus, more amount of oil is applied at each end portion than in the comparative case, thereby canceling out the adverse effect caused by the unwanted amount variations of the applied oil due to the flexure of the oil limiting blade 67. Consequently, it has become possible to obtain an uniform distribution of the applied oil over the oil applying roller 61 in its longitudinal direction.

The surface roughness at each end portion of the oil applying roller 61 can be made larger than at the central portion by various methods, and examples of which are: ① a sending rate of polishing means, such as a grinding stone and a wrapping film, is set faster for each end portion of the oil applying roller 61 than for the central portion thereof; and ② the polishing treatment is applied more at the central portion than at each end portion. In the present invention, both the method ① and ② are applicable.

Next, the relation between the peripheral speed ratio of the oil applying roller 61 and fusing roller 51 and the image quality (especially, oil banding) will be explained in detail with reference to the experiment results. The relation between the peripheral speed ratio Vo/Vf of the oil applying roller 61 and fusing roller 51 and the frequency of the oil banding is examined, and the result of which is set forth in Table 3 below.

TABLE 3

| PERIPHERAL SPEED Vo OF OIL APPLYING ROLLER (mm/sec.) | PERIPHERAL SPEED Vo OF FUSING ROLLER (mm/sec.) | PERIPHERAL SPEED RATIO Vo/VF | FREQUENCY OF OIL BANDING |
|---|---|---|---|
| 89.6 | 85 | 1.05 | X |
| 85 | 85 | 1.0 | ⊙ |
| 80.4 | 85 | 0.95 | ○ |
| 76.5 | 85 | 0.9 | X |

⊙: NO OIL BANDING OCCURS
○: SLIGHT OIL BANDING OCCURS BUT IMAGE QUALITY IS SATISFACTORY
X: IMAGE QUALITY IS DETERIORATED BY OIL BANDING

It is understood from the above result that it is ideal to secure the peripheral speed ratio Vo/Vf=1 for the oil applying roller 61 and fusing roller 51. However, since the fusing roller 51 and oil applying roller 61 are heated during the operation, and the peripheral speed of each varies with the current temperature. Thus, when the variance of the peripheral speed ratio is concerned, it is preferable to set the peripheral ratio Vo/Vf in a range between 0.95 and 1 inclusive ($0.95 \leqq Vo/Vf \leqq 1$) to prevent the occurrence of the oil banding. Therefore, in the present embodiment, the peripheral speed ratio Vo/Vf is set to 0.976.

Next, the relation between an amount of the applied oil and image quality (especially the offset and oil ghost) will be explained in detail with reference to the experiment result. The relation between an amount of the applied oil and the offset and oil ghost on the recording material is examined, and the result of which is set forth in Table 4 below.

TABLE 4

| AMOUNT OF APPLIED OIL (mg/A4) | OFFSET | OIL GHOST |
|---|---|---|
| 22.4 | ○ | X |
| 20.0 | ○ | ○ |
| 19.0 | ○ | ○ |
| 14.6 | ○ | ○ |
| 11.2 | ○ | ○ |
| 10.0 | ○ | ○ |
| 9.75 | X | ○ |
| 6.95 | X | ○ |

○: NO IMAGE DEFICIENCY OCCURS DUE TO OFFSET OR OIL GHOST
X: IMAGE DEFICIENCY OCCURS DUE TO OFFSET OR OIL GHOST

Table 4 above reveals that when an amount of the applied oil exceeds 20 mg/A4, an image deficiency occurs due to the oil ghost, and when an amount of the applied oil drops below 10 mg/A4, an image deficiency occurs due to the offset. Thus, an adequate amount of the applied oil to maintain the image quality is in a range between 10 mg/A4 and 20 mg/A4. In the present embodiment, an amount of the applied oil is set to 15.7 mg/A4 at the initial stage and 12.3 mg/A4 after passing 60,000 sheets by selecting the material of the oil limiting blade 67 and adjusting the surface roughness of the oil applying roller 61, oil viscosity and pressure on the oil limiting blade 67, etc.

Embodiment 2

Referring to the accompanying drawing, the following description will describe another example embodiment of the present invention. A fuser of the present embodiment is identical with its counterpart of Embodiment 1 except for an arrangement of the oil applying felt, and the explanation other than the oil applying felt is omitted herein for the explanation's convenience.

Figure 11:
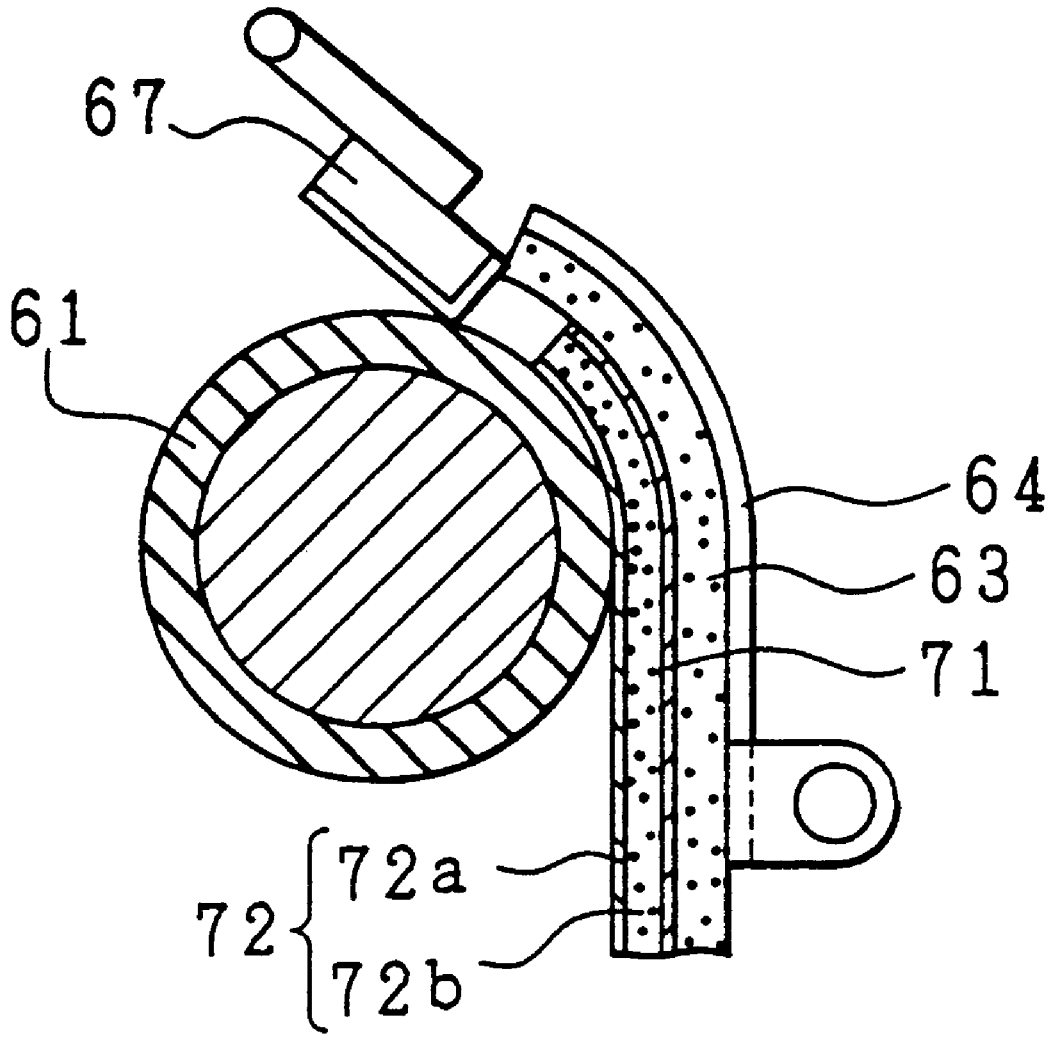
FIG. 11 is a cross section schematically showing an arrangement of a major portion of a fuser in accordance with another example embodiment of the present invention.

FIG. 11 illustrates an arrangement of an oil applying felt 72 in accordance with Embodiment 2 of the present invention. As has been explained in Embodiment 1, the fluorine-based fibers, such as PTFE fibers, shows excellent performance when used as a material of the oil applying felt 62, but there is a drawback that it is not readily produced, and therefore is relatively expensive. Thus, the oil applying felt 72 in the present embodiment is, as shown in FIG. 11, of a double-layer structure using two kinds of fibers, in which a PTFE fiber portion 72*a* as a coating fiber layer and an aramid fiber portion 72*b* as a base fiber layer are laminated to each other. The oil applying felt 72 is provided in such a manner that the PTFE fiber portion 72*a* touches the oil applying roller 61. The PTFE fiber portion 72*a* is 0.5 mm thick while the aramid fiber portion 72*b* is 1.5 mm thick, and both fiber portions are laminated firmly to each other with their fibers being tangled through the needle punching.

Thus, the fibers of the PTFE fiber portion 72*a* do not fall off while the oil applying roller 61 repetitively slides over the same, thereby attaining substantially the same performance, namely the durability, as the conventional single-layer felt. Aramid fibers cost about ⅕ of the PTFE fibers and can be readily produced. Thus, like in the present embodiment, if the PTFE fibers are used for only where being brought into contact with the oil applying roller 61 and therefore demanding the performance rendered to the PTFE, the cost of the oil applying felt 72 can be reduced by half or less compared with the oil applying felt 62 using the PTFE fibers alone. Moreover, the oil applying felt 72 can be readily produced. In the present embodiment, the aramid fiber portion 72*b* is used for where being brought into contact with the oil applying roller 61; however, any heat-resistant fiber material can be used as well.

Embodiment 3

Figure 12:
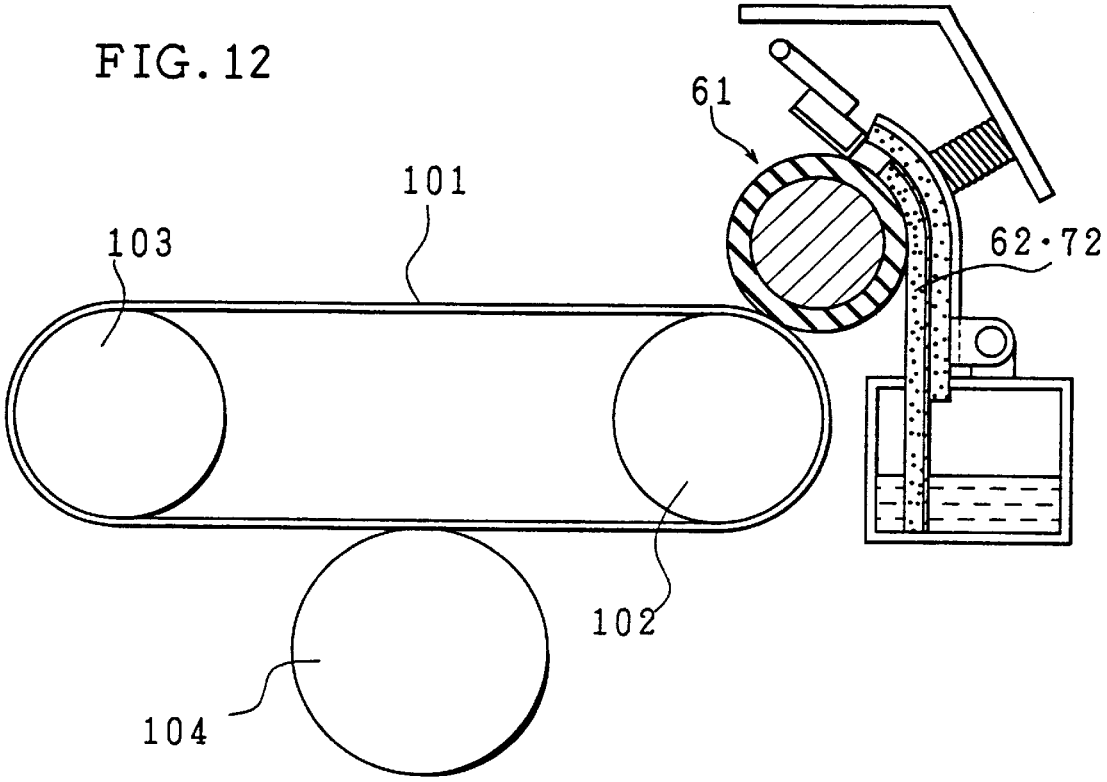
FIG. 12 is a cross section schematically showing an arrangement of a fuser in accordance with still another example embodiment of the present invention.

In Embodiments 1 and 2, the explanation is given by way of the fuser using the fusing roller 51 as an example application of the present invention. However, the present invention can be applied to a fuser using a fusing belt instead of the fusing roller 51. A schematic cross section of such a fuser using a fusing belt 101 is illustrated in FIG. 12. Since the oil applying device is identical with those used in Embodiments 1 and 2, the explanation of the same is omitted herein for the explanation's convenience. The fusing belt 101 is provided across a driving roller 102 and a tension roller 103. Certain tension is applied to the fusing belt 101 by the tension roller 103, and the fusing belt 101 is driven to turn around the driving roller 102 and tension roller 103 as the driving roller 102 rotates. Here, a fusing nip portion is formed by the fusing belt 101 and a pressure applying roller 104. The toner is fused and fixed onto the recording sheet by letting pass the recording sheet having thereon formed a non-fused toner image through the fusing nip portion.

The fusing belt 101 can be heated by various methods, for example:

① a heating source is provide inside the driving roller 102 and the fusing belt 101 is heated through the driving roller 102;

② the fusing belt 101 is made of a heating element;

③ a separate heating source is provided behind the fusing belt 101 at the fusing nip portion; etc.

The experiment results reveal that substantially the same effects as those attained in Embodiments 1 and 2 can be achieved with the fuser adopting the above belt method. Thus, it is understood that the present invention can be also applied to the fuser adopting the belt method.

Figure 13:
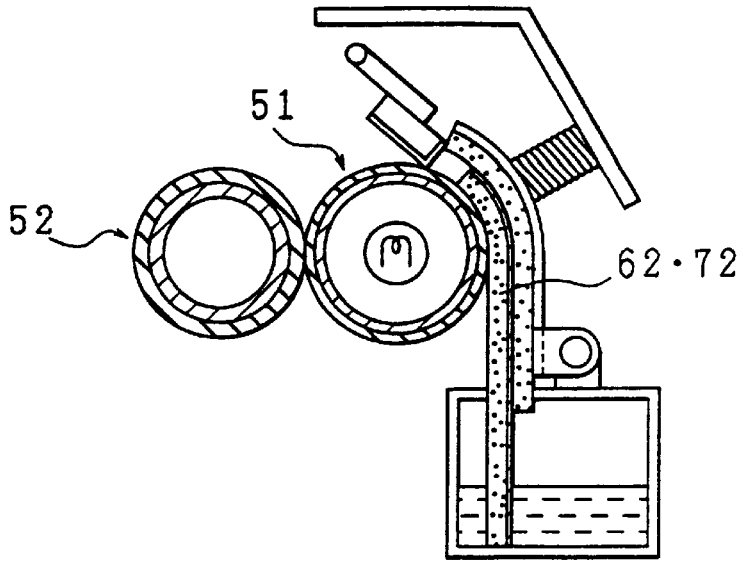
FIG. 13(*a*) is a cross section schematically showing an arrangement of a fuser in which an oil applying felt directly touches a fusing roller.
Figure 13:
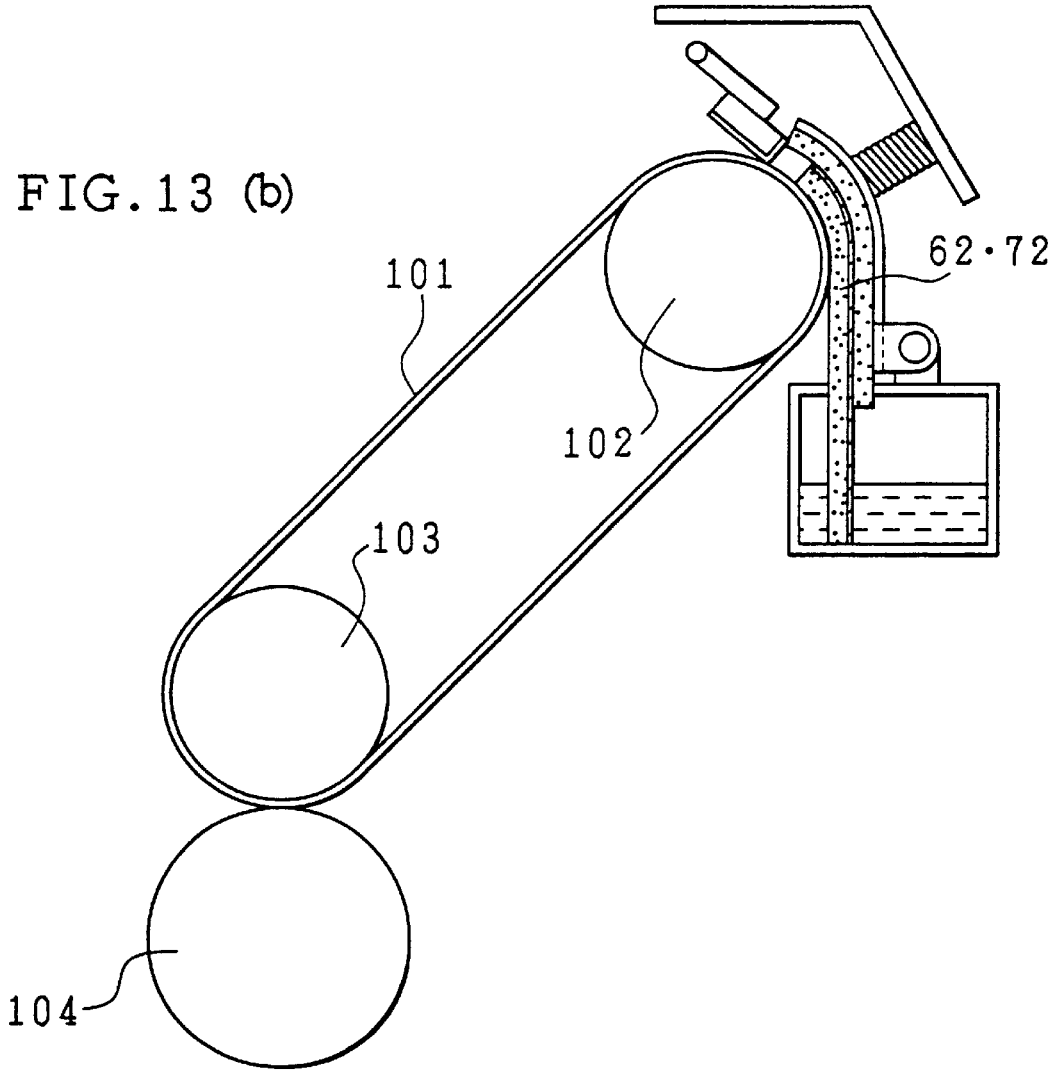
Figure 14:
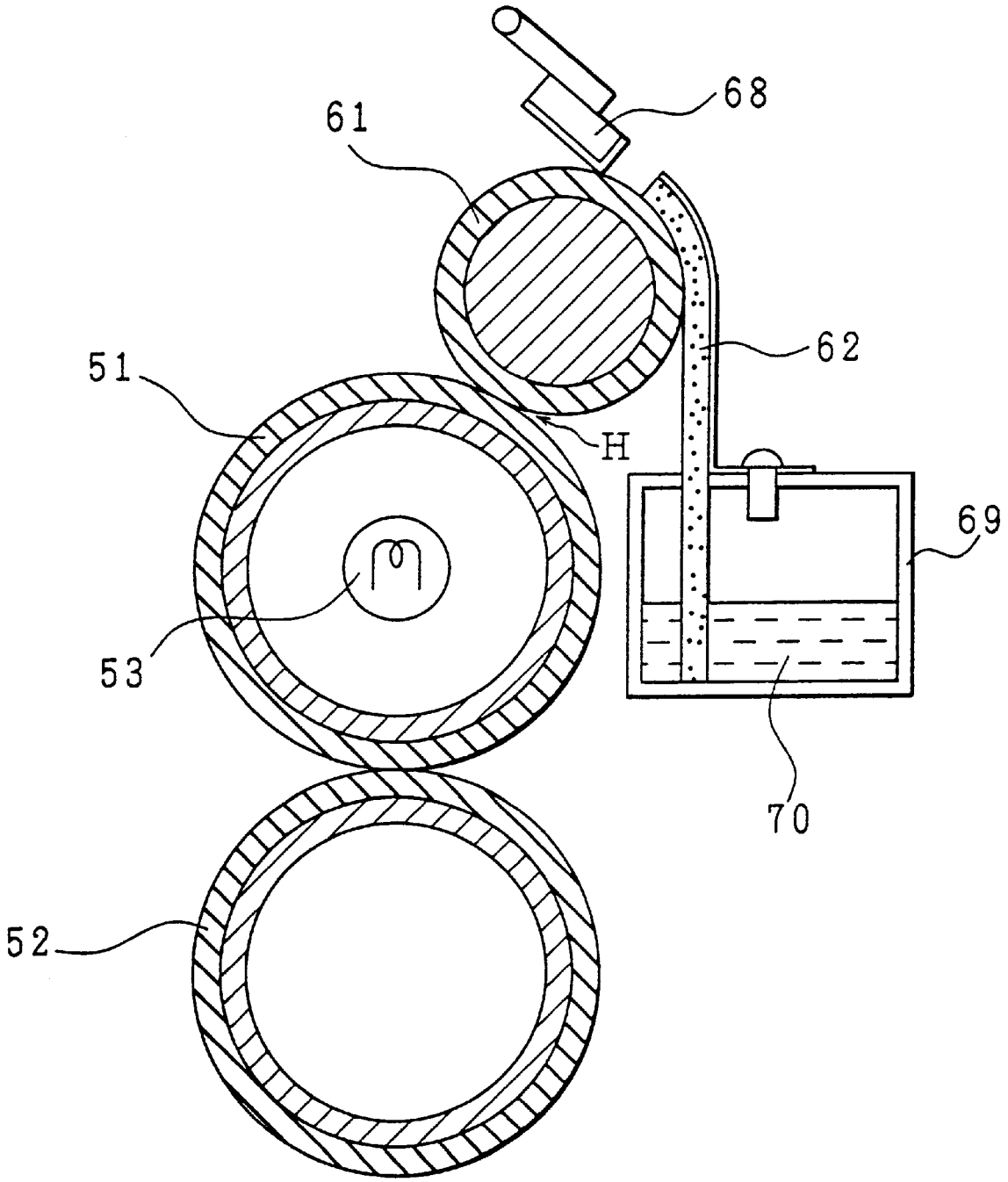
FIG. 14 PRIOR ART
FIG. 14 is a cross section schematically showing an arrangement of a conventional fuser.

In each of the above embodiments, the oil is supplied to the oil applying roller 61 that touches the fusing roller 51 or fusing belt 101 by bringing the oil applying felt 62 or 72 into contact with the same. However, the arrangement is not limited to the above, and the same can be realized by, as shown in FIGS. 13(*a*) and 13(*b*), bringing the oil applying felt 62 or 72 into direct contact with the fusing roller 51 or fusing belt 101.

As has been explained, a fuser of the present invention is a fuser comprising fusing means for fusing a non-fused toner image onto a recording material by heating and pressing, and supplying means for applying a mold release agent over the fusing means through the contact with the fusing means or applying means touching the fusing means, arranged in such a manner that at least a surface of the supplying means touching the fusing means or applying means is made of fluororesin fibers. According to the above arrangement, the supplying means is not readily stained with toner, and even when the toner adheres to the same, the clogging does not occur, thereby making it possible to supply the mold release agent in a stable manner.

Another fuser of the present invention is a fuser comprising fusing means for fusing a non-fused toner image onto a recording material by heating and pressing, applying means touching a surface of the fusing means, and supplying means for applying a mold release agent to the fusing means by supplying the mold release agent to the applying means, arranged in such a manner that an average roughness on the center line of the surface of the applying means is in a range between 0.1 $\mu$m and 0.9 $\mu$m inclusive. According to the above arrangement, an amount of applied mold release agent does not vary much throughout the life, thereby saving a total amount of used mold release agent.

Still another fuser of the present invention is a fuser comprising fusing means for fusing a non-fused toner image onto a recording material by heating and pressing, applying means composed of a roller touching a surface of the fusing means, and supplying means for applying a mold release agent to the fusing means by supplying the mold release agent to the applying means, arranged in such a manner that the surface roughness of the applying means is larger at each end portion than in the central portion in its longitudinal direction. According to the above arrangement, an amount of the applied mold release agent is even over the applying means in its longitudinal direction, thereby eliminating an image deficiency caused by the mold release agent applied nonuniformly.

Still another fuser of the present invention is a fuser comprising fusing means for fusing a non-fused toner image onto a recording material by heating and pressing, applying means composed of a roller touching a surface of the fusing means, supplying means for applying a mold release agent to the fusing means by supplying the mold release agent to the applying means, and leveling means for leveling the mold release agent applied over the applying means, arranged in such a manner that the applying means is provided to touch the fusing means and leveling means and rotate in a direction causing a small surface friction with the fusing means and leveling means along the circumferential direction. According to the above arrangement, the surface roughness of the applying means varies so little throughout the life that an amount of the applied mold release agent is stabilized, thereby saving an amount of the used mold release agent while improving the reliability of the fuser.

Still another fuser of the present invention is a fuser comprising fusing means for fusing a non-fused toner image onto a recording material by heating and pressing, applying means composed of a roller touching a surface of the fusing means, and supplying means for applying a mold release agent to the fusing means by supplying the mold release agent to the applying means, arranged in such a manner that a ratio of the peripheral speed of the applying means and the peripheral speed of the fusing means is in a range between 0.95 and 1 inclusive. According to the above arrangement, the vibration of the applying means is suppressed and therefore the applying means can be driven to rotate in a stable manner. Also, when oil is used as the mold release agent, the occurrence of the oil banding can be suppressed, and as a consequence, an image deficiency can be eliminated.

Still another fuser of the present invention is a fuser comprising fusing means for fusing a non-fused toner image onto a recording material by heating and pressing, and supplying means for applying a mold release agent over the fusing means through contact with the fusing means or applying means touching the fusing means, arranged in such a manner that the supplying means applies the mold release agent over the fusing means, and that the fusing means transfers the mold release agent onto the recording material in an amount ranging inclusively from 10 mg and 20 mg per A-4 size recording material. According to the above arrangement, when oil is used as the mold release agent, the occurrence of both the offset and oil ghost can be prevented, thereby eliminating an image deficiency.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuser comprising:

fusing means for fusing a non-fused toner image onto a recording material by heating and pressing;

applying means for applying a mold release agent over a fusing surface of said fusing device for removing toner adhering on said fusing surface; and supplying means for supplying said mold release agent to said applying means, a surface of said supplying means touching said applying means being made of fluororesin fibers.

2. The fuser of claim 1, wherein said supplying means includes a coating fiber layer made of said fluororesin fibers and a base fiber layer, said coating fiber layer being provided on either surface of said base fiber layer.

3. The fuser of claim 2, wherein said base fiber layer is made of aramid fibers.

4. The fuser of claim 1 further comprising:

storing means for storing said mold release agent;

leveling means for leveling said mold release agent supplied to said applying means from said supplying means; and returning means for returning excessive mold release agent collected by said leveling means to said storing means.

5. The fuser of claim 4, wherein said supplying means includes a coating fiber layer made of said fluororesin fibers and a base fiber layer, said coating fiber layer being provided on either surface of said base fiber layer.

6. The fuser of claim 5, wherein said base fiber layer is made of aramid fibers.

7. The fuser of claim 4, wherein said returning means is made of aramid fibers.

8. The fuser of claim 7, wherein said returning means is felt, an end portions of said felt at a side of said storing means being positioned in such a manner not to be dipped into the mold release agent stored in said storing means.

9. The fuser of claim 1, wherein an average roughness on a center line of a surface of said applying means is in a range between 0.1 $\mu$m and 0.9 $\mu$m inclusive.

10. The fuser of claim 1, wherein surface roughness of said applying means is larger at each end portion than at a central portion in a longitudinal direction thereof.

11. The fuser of claim 1 further comprising leveling means for leveling said mold release agent over said applying means, wherein said applying means is provided so as to touch said fusing means and said leveling means and rotate in a direction causing a small surface friction with said fusing means and said leveling means in a circumferential direction.

12. The fuser of claim 1, wherein a peripheral speed ratio of said applying means and said fusing means is in a range between 0.95 and 1 inclusive.

13. The fuser of claim 1, wherein said supplying means supplies said mold release agent to said fusing means, so that said fusing means transfers said mold release agent onto a recording surface of said recording material in an amount ranging inclusively from 10 mg and 20 mg per A4-size recording material.

14. The fuser of claim 1, wherein said supplying means is provided to an outside of said applying means, and directly supplied the mold release agent to an applying surface of said applying means.

15. A fuser comprising:

fusing means for fusing a non-fused toner image onto a recording material by heating and pressing; and supplying means for supplying a mold release agent to said fusing means, a surface of said supplying means touching said fusing means being made of fluororesin fibers.

16. The fuser of claim 15, wherein said supplying means includes a coating fiber layer made of said fluororesin fibers and a base fiber layer, said coating fiber layer being provided on either surface of said base fiber layer.

17. The fuser of claim 16, wherein said base fiber layer is made of aramid fibers.

18. The fuser of claim 15, wherein said supplying means supplies said mold release agent to said fusing means, so that said fusing means transfers said mold release agent onto a recording surface of said recording material in an amount ranging inclusively from 10 mg and 20 mg per A4-size recording material.

19. A fuser comprising;

a fusing roller for fusing a non-fused toner image onto a recording material by heating and pressing;

an oil applying roller for applying oil over a fusing surface of said fusing roller to remove toner adhering to said fusing surface; and an oil applying felt for supplying said oil to said oil applying roller, a surface of said oil applying felt touching said oil applying roller being made of fluororesin fibers.

20. The fuser of claim 19, wherein said oil applying roller includes a first silicon rubber layer formed through compression molding, and a second silicon rubber layer formed to coat a surface of said first silicon rubber layer.

21. The fuser of claim 19, wherein said oil applying felt includes a coating fiber layer made of said fluororesin fibers and a base fiber layer, said coating fiber layer being provided on either surface of said base fiber layer.

22. The fuser of claim 21, wherein said base fiber layer is made of aramid fibers.

23. The fuser of claim 19 further comprising:

an oil tank for storing said oil;

an oil limiting blade for leveling said oil supplied to said oil applying roller through said oil applying felt; and returning means for returning excessive oil collected by said oil limiting blade to said oil tank.

24. The fuser of claim 23, wherein said oil applying felt includes a coating fiber layer made of said fluororesin fibers and a base fiber layer, said coating fiber layer being provided on either surface of said base fiber layer.

25. The fuser of claim 24, wherein said base fiber layer is made of aramid fibers.

26. The fuser of claim 19, wherein an average roughness on a center line of a surface of said oil applying roller is in a range between 0.1 $\mu$m and 0.9 $\mu$m inclusive.

27. The fuser of claim 19, wherein surface roughness of said oil applying felt is larger at each end portion than at a central portion in a longitudinal direction thereof.

28. The fuser of claim 19 further comprising an oil limiting blade for leveling said mold release agent over said applying means, wherein said oil applying roller is provided so as to touch said fusing roller and said oil limiting blade and rotate in a direction causing a small surface friction with said fusing roller and said oil limiting blade in a circumferential direction.

29. The fuser of claim 19, wherein a peripheral speed ratio of said oil applying roller and said fusing roller is in a range between 0.95 and 1 inclusive.

30. The fuser of claim 19, wherein said oil applying felt supplies said oil to said fusing roller, so that said fusing roller transfers said oil onto a recording surface of said recording material in an amount ranging inclusively from 10 mg and 20 mg per A4-size recording material.

31. A fuser comprising:

a fusing roller for fusing a non-fused toner image onto a recording material by heating and pressing; and an oil applying felt for supplying oil to said fusing roller, a surface of said oil applying felt touching said fusing roller being made of fluororesin fibers.

32. The fuser of claim 31, wherein said oil applying felt includes a coating fiber layer made of said fluororesin fibers and a base fiber layer, said coating fiber layer being provided on either surface of said base fiber layer.

33. The fuser of claim 32, wherein said base fiber layer is made of aramid fibers.

34. The fuser of claim 31, wherein said oil supplying felt supplies said oil to said fusing roller, so that said fusing roller transfers said oil onto a recording surface of said recording material in an amount ranging inclusively from 10 mg and 20 mg per A4-size recording material.

35. A fuser comprising:

a fusing belt for fusing a non-fused toner image onto a recording material by heating and pressing;

an oil applying roller for applying oil over a fusing surface of said fusing belt to remove toner adhering to said fusing surface; and an oil applying felt for supplying said oil to said oil applying roller, a surface of said oil applying felt touching said oil applying roller being made of fluororesin fibers.

36. The fuser of claim 35, wherein said oil applying roller includes a first silicon rubber layer formed through compression molding, and a second silicon rubber layer formed to coat a surface of said first silicon rubber layer.

37. The fuser of claim 35, wherein said oil applying felt includes a coating fiber layer made of said fluororesin fibers and a base fiber layer, said coating fiber layer being provided on either surface of said base fiber layer.

38. The fuser of claim 37, wherein said base fiber layer is made of aramid fibers.

39. The fuser of claim 35, further comprising:

an oil tank for storing said oil;

an oil limiting blade for leveling said oil supplied to said oil applying roller through said oil applying felt; and returning means for returning excessive oil collected by said oil limiting blade to said oil tank.

40. The fuser of claim 39, wherein said oil applying felt includes a coating fiber layer made of said fluororesin fibers and a base fiber layer, said coating fiber layer being provided on either surface of said base fiber layer.

41. The fuser of claim 40, wherein said base fiber layer is made of aramid fibers.

42. The fuser of claim 35, wherein an average roughness on a center line of a surface of said oil applying roller is in a range between 0.1 $\mu$m and 0.9 $\mu$m inclusive.

43. The fuser of claim 35, wherein surface roughness of said oil applying felt is larger at each end portion than at a central portion in a longitudinal direction thereof.

44. The fuser of claim 35, further comprising an oil limiting blade for leveling said mold release agent over said applying means, wherein said oil applying roller is provided so as to touch said fusing roller and said oil limiting blade and rotate in a direction causing a small surface friction with said fusing roller and said oil limiting blade in a circumferential direction.

45. The fuser of claim 35, wherein a peripheral speed ratio of said oil applying roller and said fusing roller is in a range between 0.95 and 1 inclusive.

46. The fuser of claim 35, wherein said oil applying felt supplies said oil to said fusing roller, so that said fusing roller transfers said oil onto a recording surface of said recording material in an amount ranging inclusively from 10 mg and 20 mg per A4-size recording material.

47. A fuser comprising:

a fusing belt for fusing a non-fused toner image onto a recording material by heating and pressing; and an oil applying felt for supplying oil to said fusing belt, a surface of said oil applying felt touching said fusing belt being made of fluororesin fibers.

48. The fuser of claim 47, wherein said oil applying felt includes a coating fiber layer made of said fluororesin fibers and a base fiber layer, said coating fiber layer being provided on either surface of said base fiber layer.

49. The fuser of claim 48, wherein said base fiber layer is made of aramid fibers.

50. The fuser of claim 47, wherein said oil applying felt supplies said oil to said fusing roller, so that said fusing roller transfers said oil onto a recording surface of said recording material in an amount ranging inclusively from 10 mg and 20 mg per A4-size recording material.

* * * * *